United States Patent [19]

Messerschmidt

[11] 3,984,945

[45] Oct. 12, 1976

[54] DEVICE FOR LAPPING BALLS IN CONTINUOUS OPERATION

[75] Inventor: Klaus Messerschmidt, Schonungen, Germany

[73] Assignee: Sebastian Messerschmidt Spezial-maschinenfabrik, Schonungen, Germany

[22] Filed: Oct. 22, 1975

[21] Appl. No.: 624,969

Related U.S. Application Data

[63] Continuation-in-part of Ser. No. 539,502, Jan. 8, 1975, abandoned, which is a continuation of Ser. No. 322,279, Jan. 10, 1973, abandoned.

[30] Foreign Application Priority Data

Jan. 18, 1972 Germany ..... 2202098

[52] U.S. Cl. ..... 51/116; 51/117; 51/289 S

[51] Int. Cl.[2] ..... B24B 11/06

[58] Field of Search ..... 51/116, 117, 129, 130, 51/289 S

[56] References Cited

UNITED STATES PATENTS

| | | | |
|---|---|---|---|
| 703,065 | 6/1902 | Hoffmann | 51/117 |
| 1,306,767 | 6/1919 | McIntyre et al. | 51/130 |
| 1,418,887 | 6/1922 | Sellew | 51/116 X |
| 1,870,571 | 9/1932 | Kadzik | 51/289 S |
| 2,291,123 | 7/1942 | Wallace | 51/117 |
| 3,545,139 | 12/1970 | Brany | 51/289 S X |
| 3,561,164 | 2/1971 | Dunn | 51/116 |

FOREIGN PATENTS OR APPLICATIONS

| | | | |
|---|---|---|---|
| 81,491 | 9/1894 | Germany | 51/117 |

*Primary Examiner*—Al Lawrence Smith
*Assistant Examiner*—Nicholas P. Godici
*Attorney, Agent, or Firm*—Hane, Sullivan & Spiecens

[57] ABSTRACT

There is disclosed a device for lapping an unlimited number of balls in continuous operation. The device has a stationary working disc and two rotary working discs which are driven in opposite direction and at differential speeds. The rotary discs and the stationary disc define therebetween a working gap into which balls to be lapped are continuously fed and from which they are discharged after having passed through all or part of the gap. Driving of the rotary discs in opposite direction and at differential speeds causes the balls to move along the gap and to be simultaneously lapped. The rotational speeds of the rotary discs can be independently adjusted, thereby controlling the dwell time of balls in the gap.

11 Claims, 13 Drawing Figures

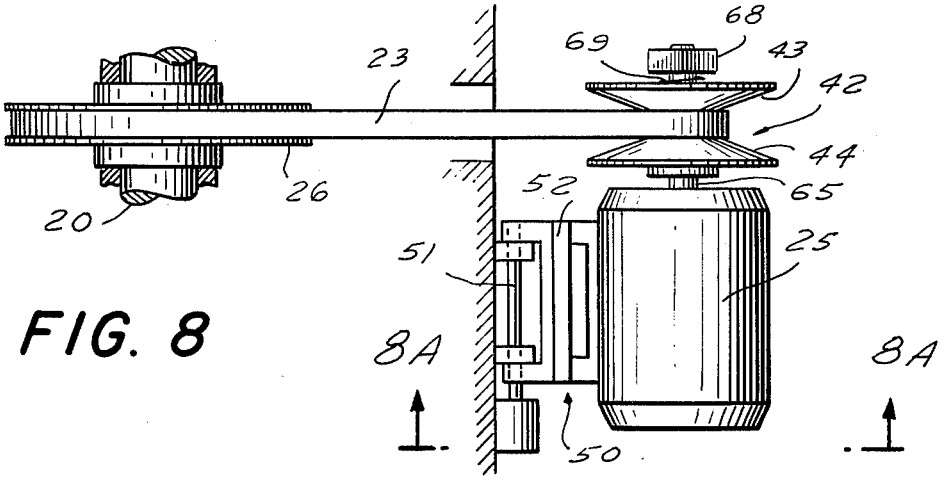
FIG. 8
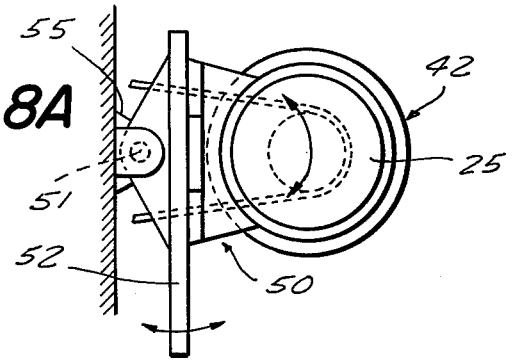
FIG. 8A
FIG. 9
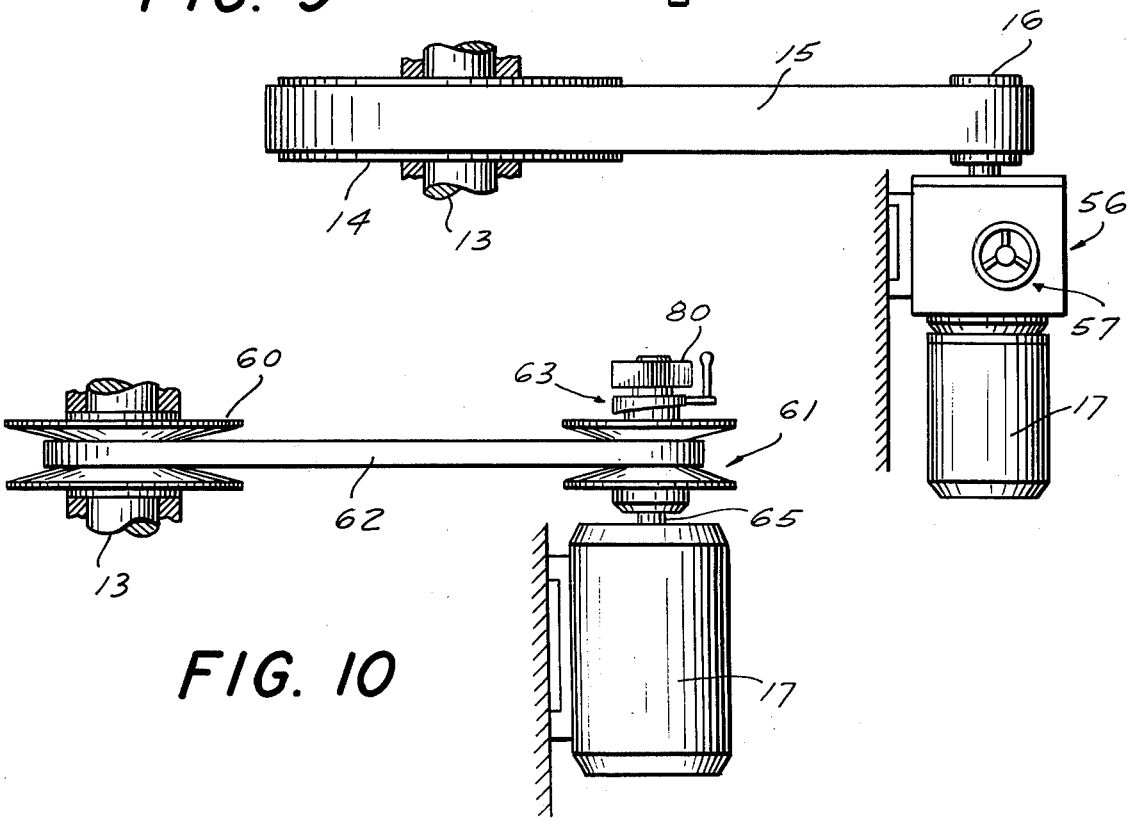
FIG. 10

FIG. 8B
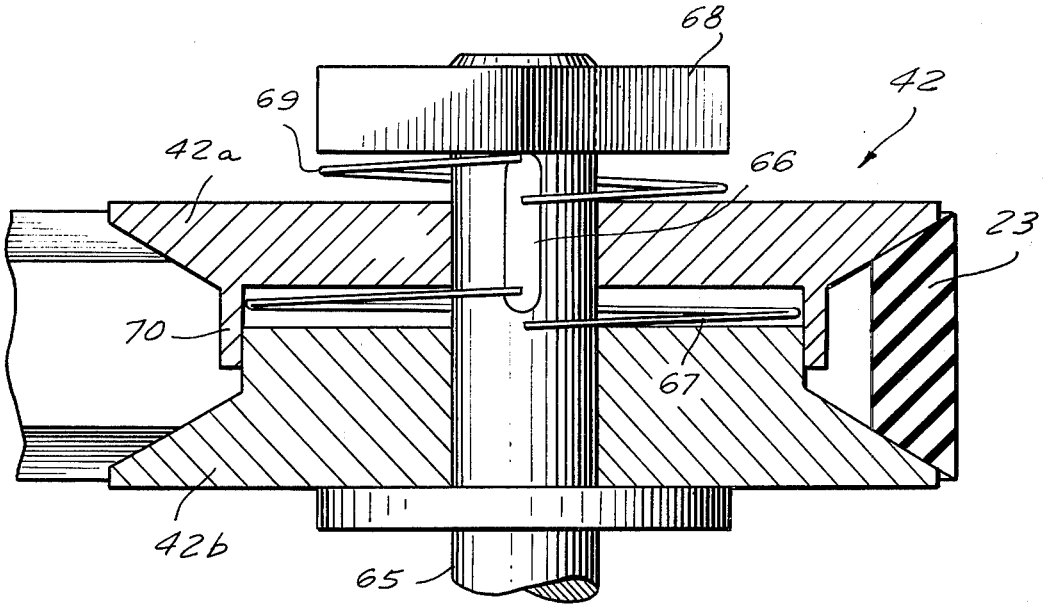
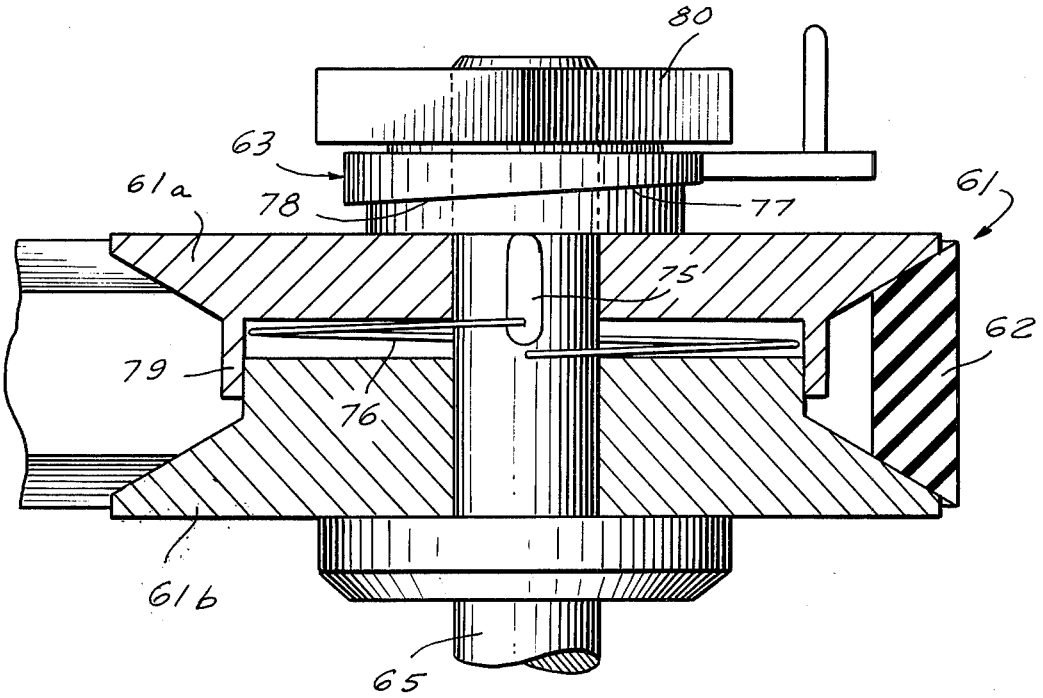
FIG. 10A

DEVICE FOR LAPPING BALLS IN CONTINUOUS OPERATION

The present application is a continuation-in-part application based on continuation application Ser. No. 539,502 filed Jan. 8, 1975, now abandoned, which in turn is based on application Ser. No. 322,279 filed Jan. 10, 1973 and now abandoned.

The invention relates to a device for lapping balls and, more particularly, to a device for lapping balls in continuous operation.

Apparatus or devices for the afore-referred to general purpose are used for grinding or polishing and lapping of spherical surfaces, that is, for soft working of balls after pressing, and also for filing, flashing, soft grinding or polishing and also for working after hardening, that is to say, for hard grinding or polishing and lapping.

In the case of a particular type of ball working apparatuses the ball is held at three points and these abutment surfaces are made annular and at least one is driven so that the balls are caused to rotate. At another position of the ball a grinding or polishing wheel comes into engagement for working the ball surface. This category of apparatus also includes constructions in the case of which both or all three discs holding the balls are caused to rotate in order to provide for a more intense treatment of the surface. This working operation is, however, at the most only suitable for pre-grinding or polishing balls, that is to say, a working operation which does not raise any high requirements as regards the evenness and complete roundness of the work pieces.

In order to achieve an improved working of the ball surface no additional grinding or polishing wheel was then used and the balls were arranged between three rotating cast discs, of which two annular discs, arranged concentrically in relation to each other, rotated in opposite directions so that the balls continuously turned about their axes. The third disc rotated coaxially in relation to the two others and thus brought about a rotation of the balls about a further axis, which lay at an angle of approximately 90° to the other axis of turning. The balls ran in grooves adapted to suit their shape. In accordance with whether use was made of at least one grinding or polishing disc or of lapping discs this method of procedure could be used for pre-grinding or polishing and also for lapping. Owing to particular features of the apparatus, however, the method was not adopted commercially. At the most, it was only suitable for working a certain series of balls dependent on the size of the discs. For changing the charge it was necessary to stop the machine and lift one disc in order to remove the balls and to place a new charge or batch in the apparatus.

Another apparatus used two discs operated less intensively but more rationally. This apparatus comprised two discs of which one rotated and the other was stationary. A sector-shaped opening was provided for a constant exchange or renewal of the balls. Owing to the fact that in the case of this apparatus several series of balls could be processed jointly on one pair of discs any number of balls could be subjected simultaneously to the grinding or lapping process without having to pay attention to the size of the balls. It is of great importance that the movement of the balls should be controlled so that the balls run along tracks of different diameter between the two discs with a constant changeover.

The requirements as regards surface quality and accuracy of the balls become more and more stringent with the requirements as regards rationalization of production. Particular importance must be paid to the requirement of being able to adapt the working of the balls as far as possible to the respective requirements in hand.

SUMMARY OF INVENTION

One object of the invention is to provide a novel and improved device for lapping balls with a high degree of precision and also for soft working of balls after processing, such as filing, flashing, soft grinding or polishing, etc.

A further object of the invention is to provide a novel and improved device which is suitable for hard grinding or polishing in such a manner that the balls can be processed by a single passage through the grooved track between working surfaces so as to be practically completely finished.

A device for working the surface of balls in a grooved track formed between two working surfaces is characterized in accordance with the invention in that the balls are worked between a stationary working surface on the one side and two working surfaces, moved in opposite directions, on the other side with one passage along the grooved track. This manner of procedure fulfills all conditions for continuous operation, since the use of a stationary disc makes possible the arrangement of a ball inlet and a ball outlet. The method furthermore makes it possible to control the timing of working of the ball surfaces within very large limits, that is to say one passage of the balls along the grooved track can serve both for a short or less intensive working and also a particularly intensive surface treatment of longer duration. This is based on the following principle:

Due to the opposite movement of the two working surfaces, which lie opposite to the stationary working surface, the balls are firstly caused to perform a type of spinning movement in the case of the use of annular disc-shaped or disc-shaped working surfaces, and they turn on the stationary working surface. It is only when there is an equal peripheral speed of these two working surfaces that the ball remains at its respective position in the groove track. Even in the case of small angular velocities of two annular discs rotating concentrically around each other the individual ball has a further component of movement imparted to it owing to a rotation about a further axis in the course of the grooved track, that is to say in the direction of movement of the annular disc with the larger radius. It is, however, now possible to arrange for the movement of at least one of the annular discs to be variable in order by a suitable difference in the speeds of movements of the two working surfaces, make possible a more or less rapid passage of the balls along the grooved track. If this difference is large, the balls will rapidly run along the whole grooved track and if it is small, the balls will only move slowly forwards, something which corresponds to intense working, in contrast to a more superficial working of short duration in the other case. By suitable setting of the conditions of movement of the two working surfaces on the one side of the balls the advance of the whole of the balls located between the three working surfaces can be regulated as desired.

The abutment surfaces of all three working surfaces envelop the balls substantially and guarantee a very effective working moment, which accelerates the grinding or polishing or lapping process in a surprising manner.

The working surfaces can be circular or annular discs. It is also possible for at least the stationary working surface arranged opposite to the rotating annular discs to form a circular arc of less than 360°. The method in accordance with the application can also be carried out with working surfaces curved in accordance with an arc and which swing backwards and forwards through an angle of less than 360° in relation to the stationary working surface. The grooved track can lie axially between the stationary working surface and two moving working surfaces. It is, however, also possible to arrange the three working surfaces in a single plane around each other so that the grooved track is located in the radial intermediate space between the three working surfaces.

The invention also discloses an apparatus or device with a ball inlet and a ball outlet. This apparatus is characterized by the combination of a stationary working surface on the one side and two working surfaces which can be moved with an opposite direction of rotation on the other side of the grooved track. The working surfaces include in this case as well as the whole zone between a closed circle, for example in the form of an annular disc, and a straight line, for example a stationary rail or a rail moving backwards and forwards linearly.

If the disc-shaped working surfaces have a sinusoidal grooved track, the manner of operation can be still further improved since in this case the engagement angle of the balls on the individual discs constantly changes. A correspondingly advantageous fact can also be achieved if the grooved track is sinusoidally shaped on one side, that is to say on the stationary working surface or on the two moving working surfaces.

In accordance with a further feature of the invention it is possible to arrange a cage protecting the balls in the grooved track in order in this manner to protect the individual balls from mutual contact and concomitant damage.

A further feature of the invention provides for the stationary working surface being arranged below the two moving working surfaces and having the ball inlet and the ball outlet. At the ball outlet and/or the ball inlet it is possible to provide a guide tract, which may be curved, for a movement of the balls in accordance with gravity. In the case of a stationary working surface arranged underneath the balls to be worked roll under their own weight along the guide path or track and enter the grooved track. This operation is not hindered by a cage in the working gap between the working surfaces. For the inlet and outlet for the balls it is sufficient to provide a simple interruption in the stationary working surfaces.

A still other and important feature of the invention is to provide a novel and improved device in which the movable working surfaces are each driven by a driving means such as an electric motor and that the speeds with which the working surfaces are driven can be independently regulated. This has the advantage that the time required by the balls to pass through the grooved track can be varied in accordance with the specific machining required by the balls whereby the drive can be rapidly and accurately set for a maximal output.

LIST OF SEVERAL VIEWS OF DRAWINGS

Further features, details and advantages of the invention will be gathered from the following description of a few embodiments.

FIG. 8 is a modification of the speed regulating means for the drive means;

FIG. 8A is a view of FIG. 8 taken on line 8A-8A of FIG. 8;

FIG. 8B is a fragmentary lengthwise section of FIG. 8 on an enlarged scale;

FIG. 9 is another modification of the regulating means;

FIG. 10 is still another modification of the regulating means; and

FIG. 10A is a fragmentary lengthwise section of FIG. 10 on an enlarged scale.

DESCRIPTION OF PREFERRED EMBODIMENTS

Figure 1:
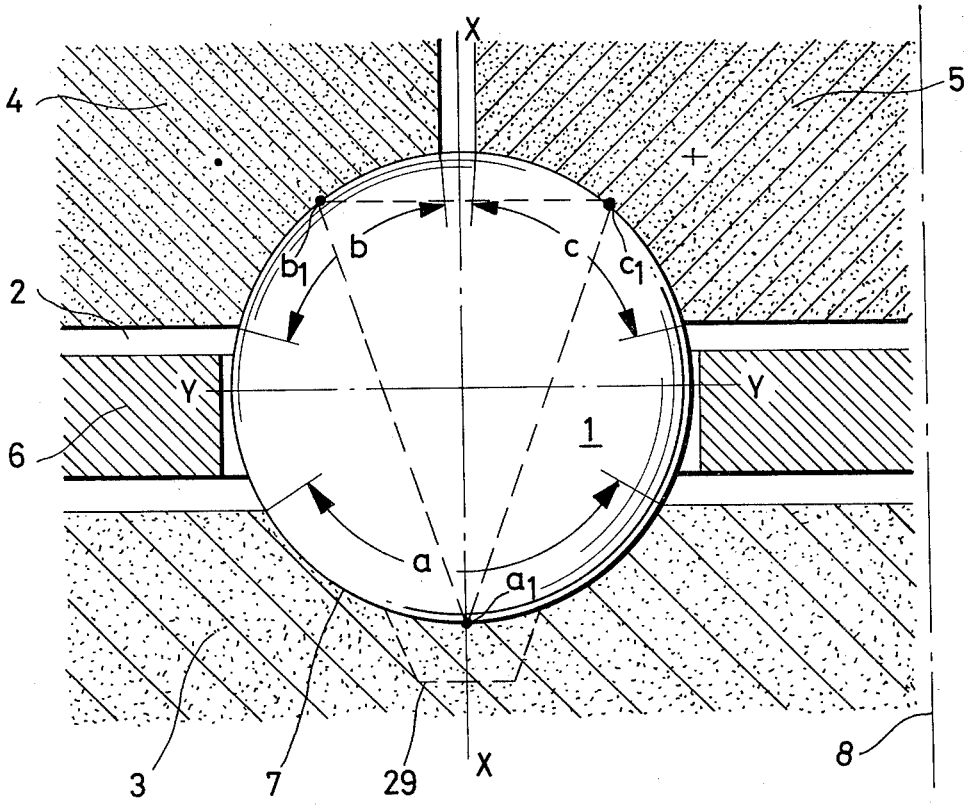
FIG. 1 is a diagrammatic cross-sectional view of a device in accordance with the invention, the section being taken at the grooved track between the working surfaces.

The ball 1 whose surface is to be worked is located in the working gap 2 between a stationary working surface 3, lying underneath the ball 1 in the case of the particular embodiment of the invention under consideration, and the two working surfaces 4 and 5 arranged on the other side of the ball, that is to say opposite. They substantially entirely envelop the ball 1 and the engagement line $a$ of the stationary working surface 3 has a central engagement point $a_1$. The engagement line $b$ in the working surface 4 corresponds to the central engagement point $b_1$ and the engagement line $c$ of the other moving working surfaces 5 corresponds to the central engagement point $c_1$. Possibly the ball 1 may be accepted in a cage 6 arranged in the working gap 2 between the working surfaces 3, 4 and 5 and this cage protects the ball against damage by knocking adjacent balls 1.

The two working surfaces 4 and 5 move, as can be seen from FIG. 1, with an opposite direction of movement leading out of the plane of the drawing. If these working surfaces 4 and 5 are constructed linearly, it is a question of a reciprocating movement which is also linear. If the working surfaces 4 and 5 are circular, the reciprocating movement can be in the form of oppositely directed reversing swinging movements. If it is a question of annular or circular working surfaces 4 and 5, a mutually opposite rotary movement of the working surfaces 4 and 5 takes place.

Due to the oppositely directed movement of the working surfaces 4 and 5 the ball 1 is firstly caused to carry out a rotary movement about its own axis $x$—$x$. In the case of an equal peripheral speed of disc-shaped working surfaces 4 and 5 the ball 1 would remain stationary in relation to the stationary working surface 3 and rotates only about its axis $x—x$. If, however, these peripheral speeds are different, a further working of the ball surface along the engagement lines $b$ and $c$ of the working surfaces 4 and 5 takes place and the ball 1 additionally rotates about an axis $y—y$ and is caused to carry out an advancing movement along the grooved track 7 in the lower stationary working surface 3. The direction of this advancing movement corresponds to the direction of movement of the working surface 4 or 5, respectively, which moves in relation to the other surface with the higher peripheral speed. It depends upon the difference in movement of the working surfaces 4 and 5 whether the balls 1 lying in the grooved track 7 pass more slowly or more rapidly along the whole length of the grooved track. This means that there is a more intense or a less intense working of the surface of the ball 1.

Figure 2:
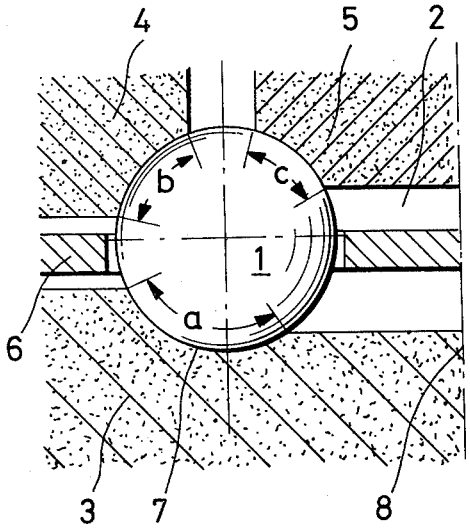
FIGS. 2 and 3 show corresponding sections of a modified embodiment of the invention.
Figure 3:
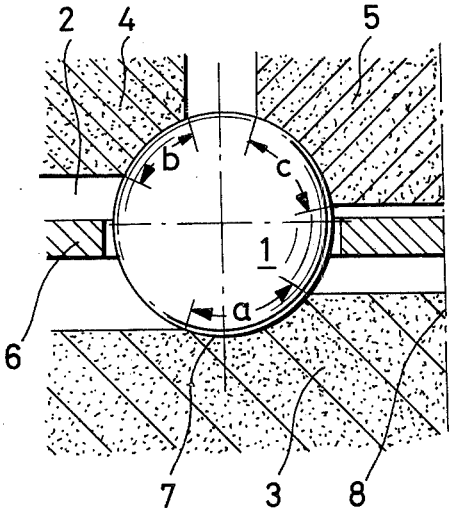
Figure 4:
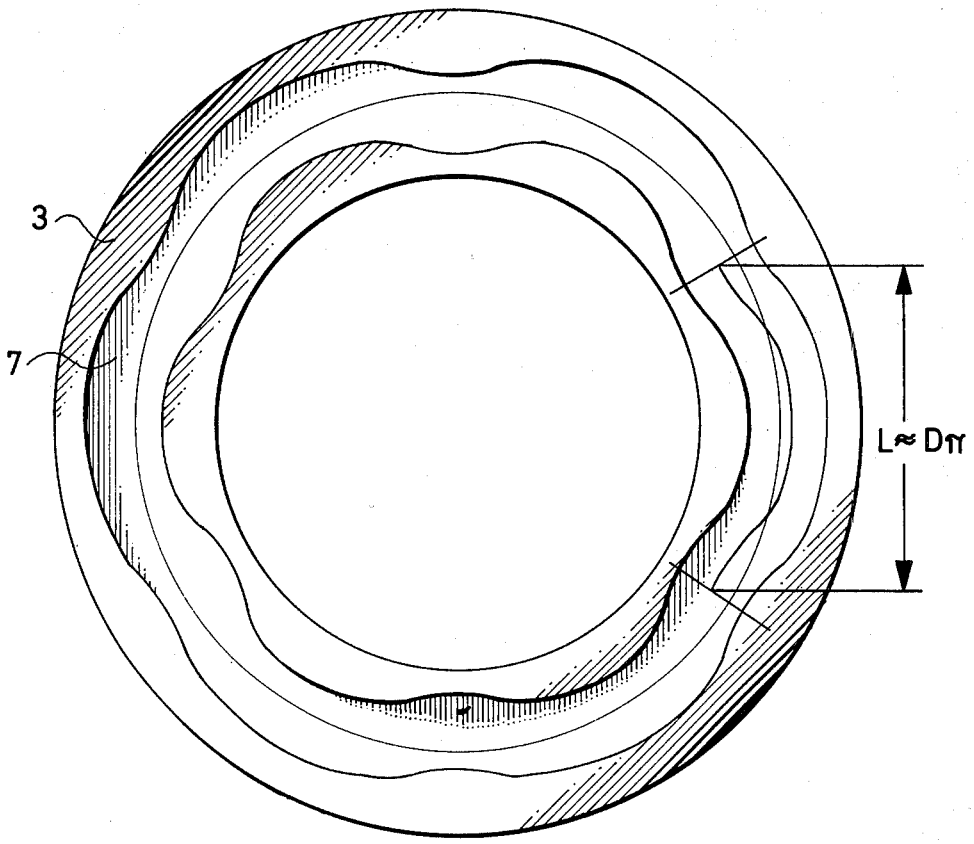
FIG. 4 is a plan view of an annular stationary working surface of the embodiment in accordance with FIGS. 2 and 3.

FIGS. 2, 3 and 4 show an embodiment of the invention in the case of which the grooved track 7 is sinusoidal and the pitch L of the sinusoidal arc is approximately the same as the periphery of the balls (D) to be worked. FIG. 2 shows an arrangement in which the engagement lines $a$, $b$ and $c$ are displaced radially outwards and FIG. 3 shows an arrangement in which they are disposed radially inwards, that is to say in the reverse direction. FIG. 4 shows a plan view of the sinusoidal grooved track 7 of a disc-shaped stationary working surface 3.

Figure 7:
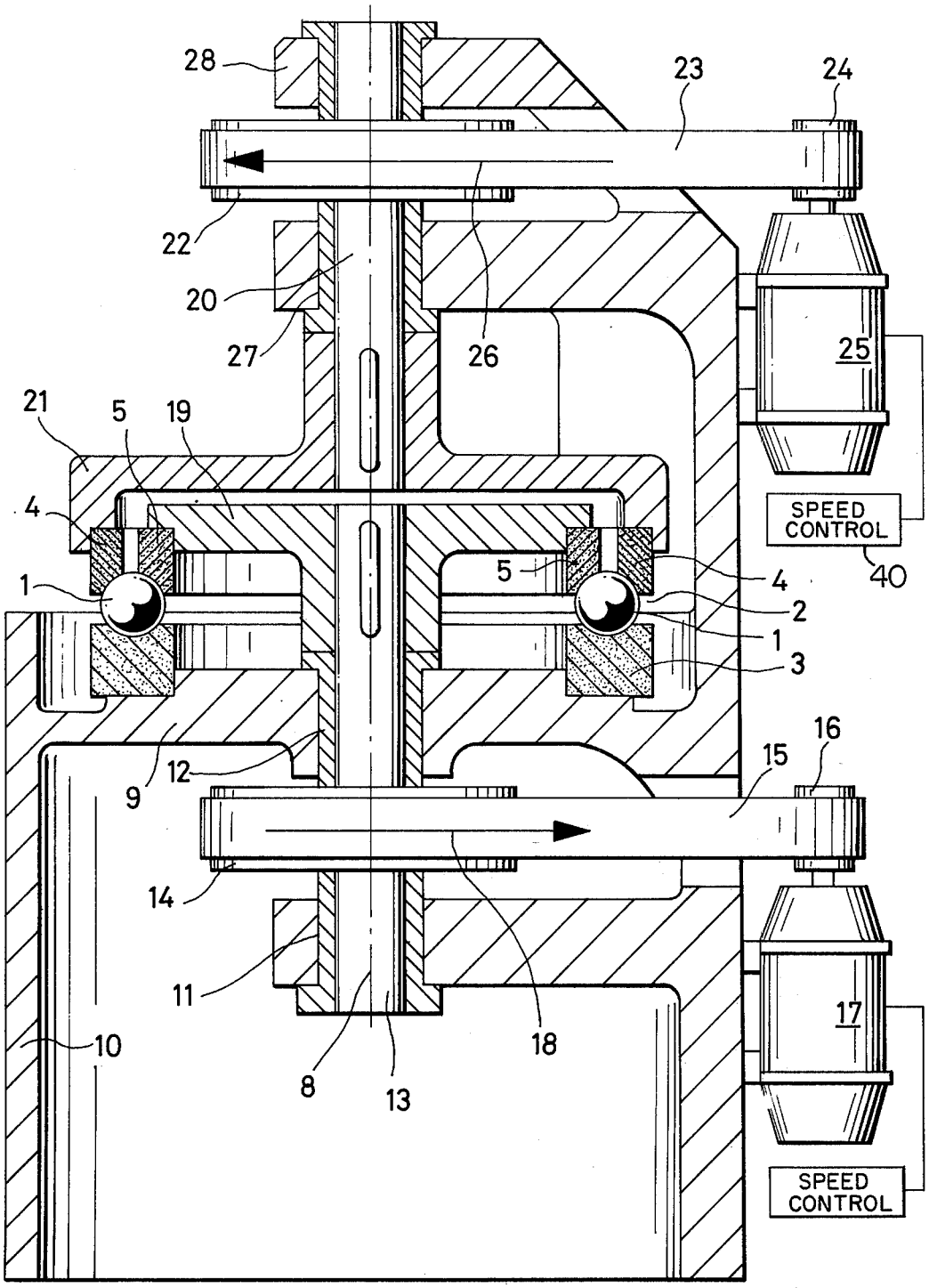
FIG. 7 shows a diagrammatic lengthwise sectional view of an embodiment of a device in accordance with the invention.

FIG. 7 shows one of a number of possible embodiments of the apparatus in accordance with the invention in which the working members 3, 4 and 5 in the form of rings or annular discs rotate about a vertical axis 8. On the cross-piece 9 of the frame 10 there rests the stationary working surface 3. In the two bearings 11 and 13 a shaft 13 is journalled, on which a drive wheel 14, for example a pulley or the like is fixed, which is connected via the drive element, such as a bell, 15 with the driving pulley 16 of an electric motor 17 mounted on the frame 10. The direction of rotation of this drive is indicated by the arrow 18. On the shaft 13 a disc-shaped support 19 for the working member 5, opposite to the stationary working member 3, is keyed. The working member 5 is in the form of an annular disc in this particular embodiment of the invention.

In the case of this embodiment of the invention there is also an annular disc-shaped working member 4 arranged concentrically around the working disc 5. The disc 4 is arranged on the support 21 fixed to the shaft 20. On this shaft 20 the drive wheel 22, for example a pulley or the like, is keyed. The pulley is connected via the drive element 23 such as a belt and the driving wheel 24 with an electric motor 25 attached to the frame 10. This drive rotates in the direction of the arrow 26 so that the working discs 4 and 5 rotate in opposite directions. The shaft 20 is journalled in the two bearings 27 and 28 of the frame 10.

As shown in broken lines in FIG. 1 the grooved track 7 in the stationary working disc 3 can be divided up by a groove 29 produced by turning.

Figure 5:
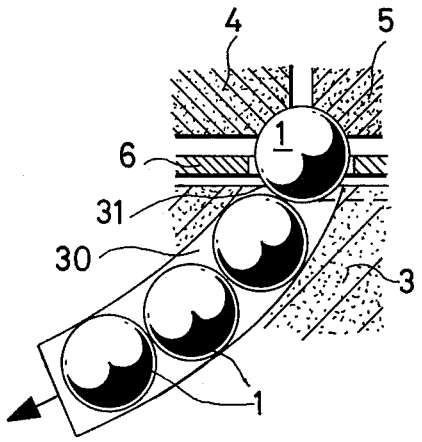
FIG. 5 is a simplified sectional view of a ball outlet.

As it is shown in FIG. 5, on working disc 3 which is stationary a recess 30 is provided as a guide track or path for the balls leaving the ball outlet 31. If a ball 1 on moving between the working discs 2 and 4 and 5 comes to the ball outlet 31, it falls automatically downwards and thus ceases to be subjected to the working process.

Figure 6:
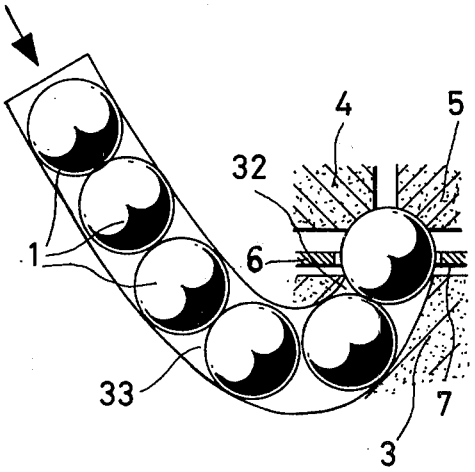
FIG. 6 is a simplified sectional view of a ball inlet.

In the direction of movement of the balls 1 along the grooved track 7 a ball inlet 32 follows the ball outlet 31. This ball inlet 32 is shown in FIG. 6 by way of example and has a guide track 33, which leads with a slight curvature from a higher level to the ball inlet 32 so that the weight of the balls 1 located in the guide 33 causes the balls to pass into the grooved track 7.

As it is evident, the speed differential between working discs 4 and 5 controls the speed of movement of the balls through the gaps and thus the dwell time of the balls in the gap. The invention provides that the relative speed of the rotary discs can be independently regulated, thereby correspondingly varying the dwell time. This has the advantage that the dwell time can be set in accordance with the extent of lapping required by balls to be machined in the device. As a result, the device can be conveniently and rapidly set for pushing of balls in one passage and thus for maximal output and, most economic use.

Various means, conventional and non-conventional, can be provided, and are available, for regulating the relative speeds of working discs 4 and 5. It is, for instance, possible and practical to change the diameter of pulleys 14 and 22 so that the desired speed differential is obtained. The ratios of transmission means between drive motors 17,25 and the respective pulleys can be gradually or stepwise varied but generally it is more convenient to vary the rotational speed at the motors themselves. There is indicated in FIG. 7 for each of the drive motors a block 40 and 41, respectively, including the legend "speed regulator." These blocks are indicated to be connected to the respective motor and should be visualized as including conventional and suitable speed regulators as are readily available in the market. Of course, it may be sufficient to change the speed of one motor only.

Provision of speed regulators for each of the motors permits varying the rotational speeds of the two motors independently of each other and thus, also, the rotational speeds of working discs 4 and 5. Regulation of the r.p.m. of either of the two motors can be effected either automatically or by manual control as it is well-known in the art.

FIGS. 8, 8A and 8B show further speed adjustment means for varying the speed with which pulley 26 is driven by belt 23. There is shown a pulley 42 of the type having conical side walls 43 and a cylindrical center portion 44. Belt 23 is shown as riding on the center portion 44 of the pulley, that is, belt 23 shown as a V-shaped belt, is driven at the minimum speed provided by the r.p.m. of the motor on constant. Speed transmitted to pulley 26 can be increased by tilting pulley 42 so that the belt is riding on one of the conical inner side walls of the pulley, thereby increasing the effective diameter of pulley 42.

Referring to FIG. 8B, pulley 42 consists of two halves 42$a$ and 42$b$. Pulley half 42$b$ is fixedly secured to motor shaft 65 for driving by this shaft. The other pulley half is keyed to the shaft by a key 66 so that it is also driven by shaft 65 but is axially slidable relative to pulley half 42$b$ thereby varying the spacing between the two pulley halves. A spring 67 between the two pulley halves biases pulley half 42$a$ in the direction away from pulley half 42$b$. This upward movement of pulley half 42$a$ is limited by a disc or protrusion 68 fixedly secured to shaft 65. A second spring 69 biases pulley half 42$a$ towards the other pulley half, i.e., the two springs act in opposition. The gap between the two pulley halves is bridged by an annular flange 70. As it is evident, tilting of pulley 42 will cause a change in the spacing of the two pulley halves and thus a corresponding change in the position of belt 23 relative to the conical inner wall surfaces of the pulley, thereby correspondingly changing the speed which is transmitted by belt 23 to pulley 26.

Tilting of pulley 42 is effected by mounting motor 25 on a frame structure 50 which is pivotal together with motor 25 about a pivot pin 51. This pivoting can be effected by a lever 52 in one direction or the other out of the position in which it is shown in FIG. 8. Such pivoting can be manually effected, or by speed adjustablr auxiliary motor 55 as it is shown in FIG. 8A. Of course, conventional hydraulic or servo means can also be used for the purpose. The same or similar arrangement may also be provided for motor 17 to vary the r.p.m. of pulley 14.

FIG. 9 shows an arrangement in which the r.p.m. of rotary disc 14 can be adjusted by interposing a variable gear drive 56 between motor 17 and pulley 16. Variable gear drives are widely known and readily available in the market. The transmission ratio of the gear drive can be readily stepwise or gradually adjusted, either manually or automatically. A knob or wheel 57 for adjusting the ratio of the gear drive is indicated. The arrangement which is shown in FIG. 9 for motor 17 can, or course, also be used for motor 25.

According to FIGS. 10 and 10A, the rotational speed of either working disc can be adjusted by providing at shaft 13 and on the drive shaft 65 of motor 17 pulleys 60 and 61 of the conical type. The belt 62, such as a V-belt, is shown at the center part of the pulleys, that is, transmission of speed is at the minimal ratio. A manually or automatically operable wheel 63 is provided for setting pulley 61 so that the belt 62 is forced into positions in which the ratio of transmission is either increased or decreased as selected.

Referring to FIG. 10A, pulley 61 is similar to pulley 42 in that the pulley consists of two halves 61*a* and 61*b*. Pulley half 61*b* is fixedly secured to motor shaft 65 while pulley 61*a* is keyed to the shaft by a key 75 so that the pulley half can be axially displaced relative to pulley half 61*b* but is also driven by shaft 65. A spring 76 biases pulley half 61*a* in the direction away from the other pulley half. An annular flange 76 bridges the gap between the two pulley halves.

Wheel 63 has on its bottom side a cam surface 77 which coacts with a cam surface 78 on the top side of pulley half 61*a*. The pulley assembly and also the hand wheel are retained on motor shaft 65 by a lock washer 80 or other suitable element. As it is apparent, turning of the hand wheel will vary the position of pulley half 61*a* relative to pulley half 61*b* against the action of spring 76, thereby correspondingly varying the position of V-shaped belt 62 relative to the conical walls of the pulley and thus correspondingly changing the rotational speed transmitted to pulley 60.

Of course, the afore-referred to manual control means can be replaced in the disclosed control assemblies by electrical, hydraulic or otherwise operated control means. The V-shaped transmission belts can be replaced by chain belts.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

I claim:

1. A ball lapping device for lapping an unlimited number of balls in continuous operation, said device comprising in combination:

two rotary working discs and one stationary working disc, said two rotary discs and said stationary disc being mounted in fixed special relationship so as to define therebetween an elongate working gap and said stationary disc having in its side facing the rotary discs an elongate guide track for guiding balls to be lapped along the working gap;

a rotary drive means and a transmission means for each of said movable working discs, each of said transmission means coupling the respective drive means to one of said working discs for driving said discs in opposite directions and at a selected differential speed, said opposite and differential rotations of the discs imparting to balls in said track a rotary movement and a movement along the track, the speeds of said movements being a function of the selected speed differential;

speed regulating means coupled to at least one of said drive means for regulating the rotational speeds of the working discs independent of each other for selecting the relative speeds of the discs thereby correspondingly varying the travel time of balls between said inlet and said outlet; and ball inlet means communicating with said guide track for successively feeding balls to be lapped into the same and ball outlet means communicating with the track for successively discharging lapped balls from the guide track, said outlet means communicating with the guide track at a point spaced from the inlet means in the direction of movement of balls along the track.

2. The ball lapping device according to claim 1 wherein said discs are annular discs disposed in coaxial relationship, said rotary working discs being radially spaced apart and located in the same plane in superimposition with the stationary working disc, and wherein each of the rotary discs is secured to a support means, each of said support means being coupled to the respective transmission means.

3. The ball lapping device according to claim 2 wherein each of said support means comprises a holder and a shaft secured to the holder for joint rotation therewith, said shafts being disposed in axial alignment and coupled to the transmission means.

4. The ball lapping device according to claim 1 wherein said guide track is a substantially circular track coaxially with the discs, said inlet and outlet means communicating with the track being circumferentially spaced.

5. The ball lapping device according to claim 4 wherein said guide track has a substantially sinusoidal configuration along its length.

6. The ball lapping device according to claim 1 wherein said inlet means and said outlet means each comprise a chute, each of said chutes including a portion so slanted that balls entering either one of the chute portions are guided respectively into and out of said guide track by gravitational force.

7. The ball lapping device according to claim 1 and comprising a cage disposed within said working gap, said cage including spaced apart openings, each for accommodating therein one of said balls to prevent direct contact between balls.

8. The ball lapping device according to claim 1 wherein said guide track includes a crosswise disposed groove dividing the track into two parts.

9. The ball lapping device according to claim 1 wherein a speed regulating device is provided for each of said rotary drive means, each of said speed regulating means being independently settable for a selected speed.

10. The ball lapping device according to claim 9 wherein each of said transmission means comprises a first pulley fixedly coupled to the respective rotary working disc, a second pulley coupled to the respective drive means for driving by the same and a transmission member extending between said pulleys, and wherein each of said speed regulating means coacts with the respective rotary drive means for selectively varying the rotational speed thereof thereby correspondingly varying the rotational speed of the first pulley.

11. The ball lapping device according to claim 9 wherein each of said transmission means comprises a first pulley fixedly coupled to the respective rotary working disc, a second pulley coupled to the respective drive means for being driven by the same and a transmission member extending between said pulleys, and wherein each of said speed regulation means comprises setting means for selectively varying the position of the second pulley relative to the first pulley so as to vary the rotational speed transmitted from the second pulley to the first pulley.

* * * * *